US008820031B2

(12) United States Patent
Kufner et al.

(10) Patent No.: US 8,820,031 B2
(45) Date of Patent: Sep. 2, 2014

(54) TILE ALIGNMENT AND LEVELING DEVICE

(71) Applicant: Davinci Italia/USA Group, LLC, Fairfield, IA (US)

(72) Inventors: Edward A. Kufner, Fairfield, IA (US); Ralph Burgin, West Point, IA (US)

(73) Assignee: Davinci Italia/USA Group, LLC, Fairfield, IA (US)

( * ) Notice: Subject to any disclaimer, the term of this patent is extended or adjusted under 35 U.S.C. 154(b) by 0 days.

(21) Appl. No.: 13/853,523

(22) Filed: Mar. 29, 2013

(65) Prior Publication Data

US 2013/0255182 A1 Oct. 3, 2013

Related U.S. Application Data

(60) Provisional application No. 61/617,487, filed on Mar. 29, 2012.

(51) Int. Cl.

| | |
|---|---|
| ***E04D 15/00*** | (2006.01) |
| ***E04F 21/00*** | (2006.01) |
| ***E04G 21/14*** | (2006.01) |

(52) U.S. Cl.

CPC ..... *E04F 21/00* (2013.01); *E04F 21/0092* (2013.01)

USPC ..... 52/749.11; 52/222; 52/126.6; 52/127.7; 52/747.11; 52/389

(58) Field of Classification Search

CPC ..... E04F 21/00; E04F 21/04; E04F 21/18; E04F 21/1838; E04F 21/1844; E04F 21/185; E04F 21/1877; E04F 21/20; E04F 21/22; E04F 2015/02116

USPC ..... 52/222, 126.6, 127.7, 749.11, 747.11, 52/389, 384

See application file for complete search history.

(56) References Cited

U.S. PATENT DOCUMENTS

| | | | |
|---|---|---|---|
| 1,817,447 | A | 8/1931 | Simpson |
| 3,301,121 | A | 1/1967 | Newcomer |
| 3,511,001 | A | 5/1970 | Morgan |
| 3,537,146 | A | 11/1970 | Caveney |
| 4,286,497 | A | 9/1981 | Shamah |
| 4,397,124 | A | 8/1983 | Redman |
| 4,397,125 | A | 8/1983 | Gussler |

(Continued)

FOREIGN PATENT DOCUMENTS

| | | |
|---|---|---|
| BE | 815 222 | 9/1974 |
| FR | 2 328 811 | 5/1977 |

OTHER PUBLICATIONS

European Search Report EP 11000098—Gert Stevens.

*Primary Examiner* — Mark Wendell
(74) *Attorney, Agent, or Firm* — Ryan N. Carter

(57) ABSTRACT

A tile alignment and leveling device for aligning and leveling tiles as they are being secured to a substrate. The device includes a flexible member, a bottom plate, and an intermediate member. The intermediate member spaces the flexible member and bottom plate a predetermined vertical distance. The flexible member has a first end and a second end. The first end is pivotally combined with the intermediate member thereby allowing the flexible member to pivot between a first position and a second (downward) position. In use and in its second position, the flexible member second end exerts force against the top of the tiles to help align and level the tiles as they are secured to the substrate.

21 Claims, 15 Drawing Sheets

(56) References Cited

U.S. PATENT DOCUMENTS

| | | | | |
|---|---|---|---|---|
| 4,503,654 | A | 3/1985 | Consentino | |
| 4,558,544 | A | 12/1985 | Albrecht | |
| 4,809,477 | A | 3/1989 | Gasser | |
| 4,865,501 | A | 9/1989 | Ferris | |
| 4,897,899 | A | 2/1990 | Shely | |
| 5,000,890 | A | 3/1991 | Distefano | |
| 5,209,621 | A | 5/1993 | Burbidge | |
| 5,212,920 | A | 5/1993 | Tye | |
| 5,263,260 | A | 11/1993 | Smith | |
| 5,288,534 | A | 2/1994 | Tavshanjian | |
| 5,568,785 | A | 10/1996 | Hazen | |
| 5,584,452 | A | 12/1996 | Koike | |
| 5,601,261 | A | 2/1997 | Kioke | |
| 5,603,195 | A | 2/1997 | Consentino | |
| 5,607,256 | A | 3/1997 | McCleary | |
| 5,674,942 | A | 10/1997 | Hill | |
| 5,675,942 | A | 10/1997 | Crawford | |
| 5,702,218 | A | 12/1997 | Onofrio | |
| 5,832,619 | A | 11/1998 | Volkema | |
| 5,875,606 | A | 3/1999 | Jensen | |
| 5,966,781 | A | 10/1999 | Geiger | |
| 6,000,184 | A | 12/1999 | Fernandes | |
| 6,347,435 | B1 | 2/2002 | Davignon | |
| 6,412,185 | B1 | 7/2002 | Mills | |
| 6,578,239 | B2 | 6/2003 | Hatch | |
| 6,625,951 | B1 | 9/2003 | McCarthy | |
| 6,658,703 | B1 | 12/2003 | Teagno | |
| 6,704,972 | B2 | 3/2004 | Pyle | |
| 7,001,126 | B2 | 2/2006 | Lesecq | |
| 7,257,926 | B1 | 8/2007 | Kirby | |
| 7,520,030 | B2 | 4/2009 | Laporte | |
| 7,621,100 | B2 * | 11/2009 | Kufner et al. | 52/749.11 |
| 7,954,300 | B1 | 6/2011 | Kufner | |
| 8,099,926 | B2 | 1/2012 | Kufner | |
| 8,181,420 | B2 * | 5/2012 | Torrents I Comas | 52/749.11 |
| 8,336,279 | B2 | 12/2012 | Kufner | |
| 8,429,878 | B1 * | 4/2013 | Hoffman et al. | 52/747.11 |
| 8,429,879 | B1 * | 4/2013 | Hoffman et al. | 52/747.11 |
| 8,561,370 | B1 * | 10/2013 | Hoffman et al. | 52/747.11 |
| 8,572,927 | B1 * | 11/2013 | Hoffman et al. | 52/747.11 |
| 8,635,815 | B2 * | 1/2014 | Bordin | 52/126.1 |
| 2002/0157339 | A1 | 10/2002 | Repasky | |
| 2002/0187020 | A1 | 12/2002 | Julien | |
| 2003/0177613 | A1 | 9/2003 | Caveney | |
| 2006/0185269 | A1 | 8/2006 | Kufner | |
| 2007/0266531 | A1 | 11/2007 | Krisel | |
| 2008/0236094 | A1 | 10/2008 | Doda | |
| 2010/0263304 | A1 | 10/2010 | Torrents I Comas | |

* cited by examiner

TILE ALIGNMENT AND LEVELING DEVICE

This application is based upon U.S. Provisional Application Ser. No. 61/617,487 filed Mar. 29, 2012, the complete disclosure of which is hereby expressly incorporated by this reference.

BACKGROUND

This invention is directed to the field of laying and leveling tile and slabs. More particularly, the invention is directed to a device for aligning and leveling adjacent tiles as they are laid in floors, walls, countertops, and the like.

Tile has become a popular decorative and functional article for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip and fall on unevenly laid tiles. "Lippage" occurs when the edge of one tile is higher than the adjacent tile to a degree where someone could trip. Replacing or otherwise correcting errors in tile installation (such as lippage or improper tile alignment) takes time that adds to the total cost of the tile installation.

Laying and leveling tile can be difficult because many substrates are uneven, such as the ground when laying tile for an outdoor patio. In this case, it can be difficult to raise the low areas of the substrate with mortar or other objects so that all the tiles are level. Further, tiles can shift and sink into mortar as the mortar dries. It has traditionally been necessary to continually monitor newly laid tiles as the mortar dries to ensure that the tiles remain level. Tile installers have used a variety of devices and methods to maintain quality tile installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles an appropriate distance. This type of frame is typically a fixed grid which is designed for a specific tile size. One problem with this device is that it is a fixed size which requires a professional installer to carry multiple frames in order to install various tile sizes. A further disadvantage of this type of frame is that it is only capable of installing one type of tile at a time.

Another device used to lay and align adjacent tiles is a spacer such as the one described in U.S. Pat. No. 6,625,951 (McCarthy). These types of spacers typically provide a square edge for properly aligning adjacent tiles at right angles, and a height adjustment means for adjusting the height of the tiles relative to the mortar surface. One problem with these types of devices is that it is difficult to set multiple spacers to the same height which often results in an uneven tile surface. A related problem with these types of devices is that the adjustment means does not allow the height of the tiles to be adjusted after the tile is laid because the height adjustment means is located under the tile.

Therefore, there is a need for an efficient and inexpensive tile leveling and alignment device that allows for the vertical alignment of tiles relative to each other after the tiles have been laid in the mortar.

SUMMARY

The invention comprises a tile alignment and leveling device. The device can be used to align and level tiles that are being secured to any suitable substrate, including floors, walls, and countertops. In some embodiments the device includes at least one flexible member and a bottom plate combined by an intermediate member. In other embodiments the device includes a bottom plate having a shaft extending upwardly therefrom and an intermediate member combined with at least one flexible member, said intermediate member having an opening adapted to receive the shaft. The flexible members have a first end and a second end. The first end is pivotally combined with the intermediate member thereby allowing the flexible members to pivot between a first (upward) position and a second (downward) position. In some embodiments the device includes a means for securing the flexible members in their second position.

A typical first step in laying tile is the application of a setting bed, such as a cement or mortar compound, to the substrate surface. Thereafter, the tiles can be placed in the setting bed. During these steps the bottom plate is positioned in the setting bed beneath the tiles so that the intermediate member (or shaft in some embodiments) extends upward between adjacent tiles. The bottom plate is preferably positioned so that it is in contact with more than one tile. The flexible members are in their first position as the tiles are placed on the bottom plate. Thereafter, the flexible members are moved to their second position wherein the second end of the flexible members presses against the top of the tiles causing the top of the tiles to be aligned together on the same plane with minimal or no lippage. The device keeps the tiles level relative to the adjacent tiles, not relative to the substrate surface.

After the setting bed dries, thereby securing the tiles to the substrate, the intermediate member (or shaft in some embodiments) is separated from the bottom plate leaving the bottom plate beneath the set tiles. One of ordinary skill in the art would understand that a plurality of tile leveling devices can be simultaneously used between different tiles being laid on a substrate so as to level many tiles at the same time.

DETAILED DESCRIPTION

Figure 1:
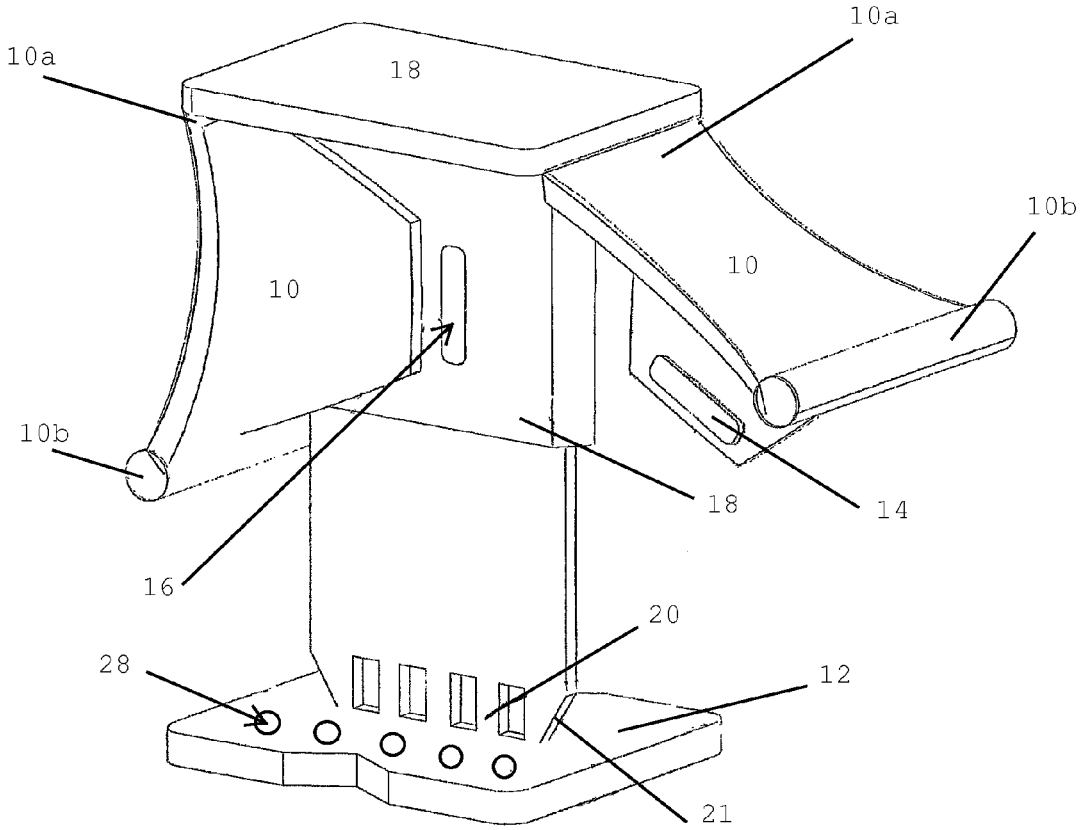
FIG. 1 is a perspective view of an embodiment of the invention.
Figure 2:
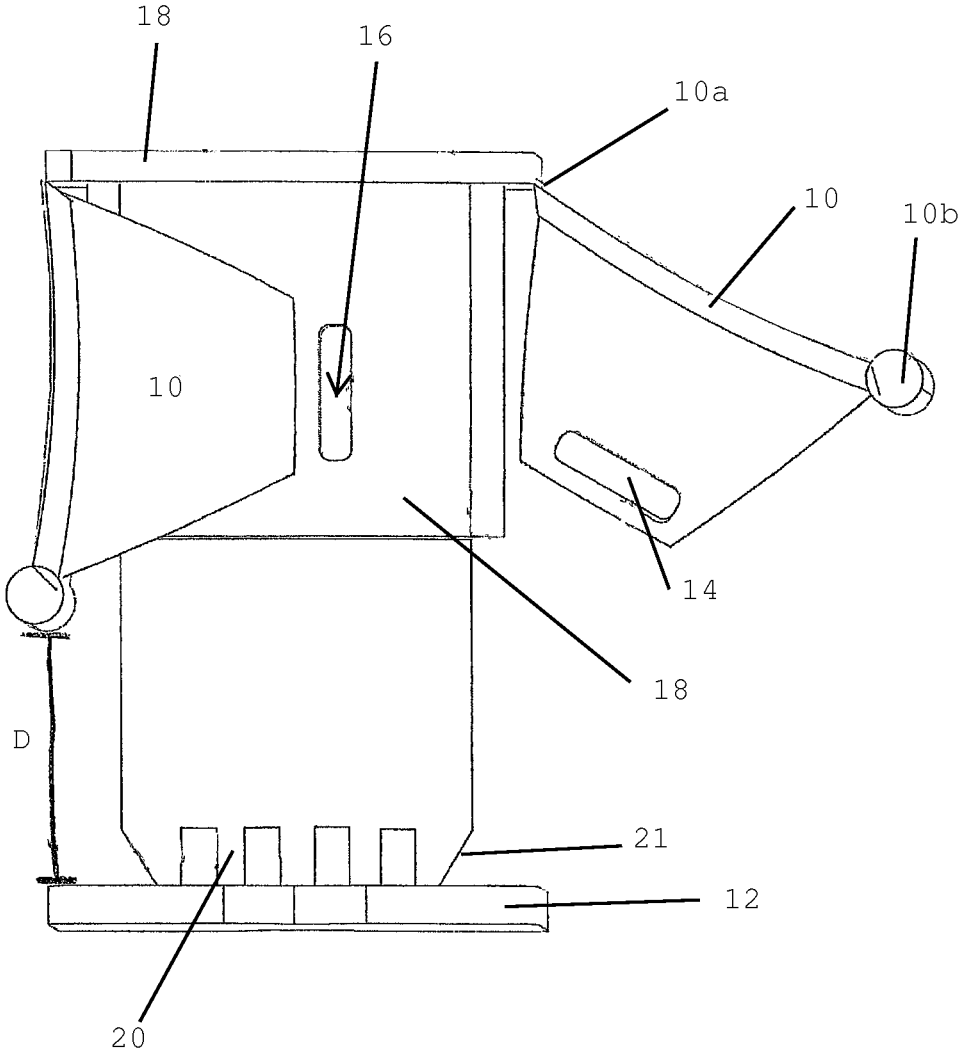
FIG. 2 is a front view of an embodiment of the invention.
Figure 3:
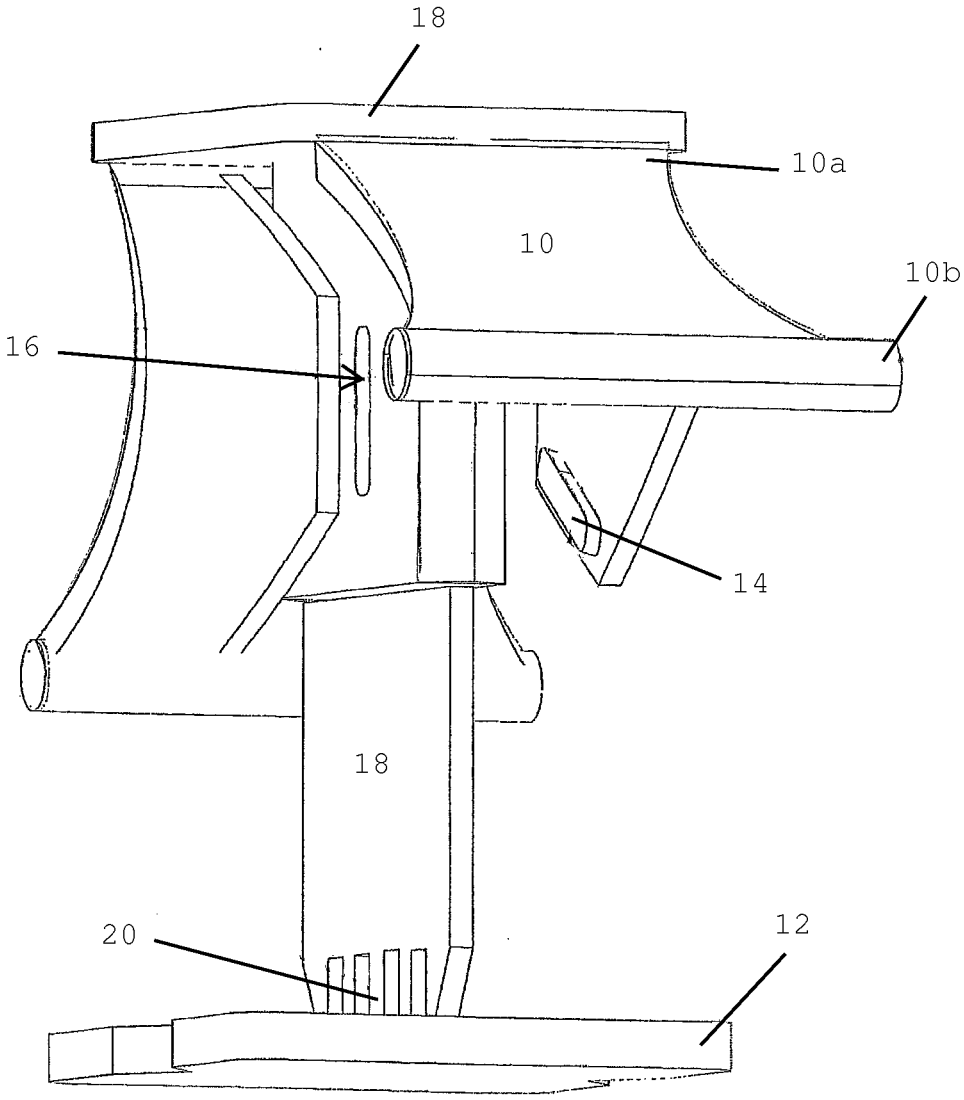
FIG. 3 is a perspective view of an embodiment of the invention.
Figure 4:
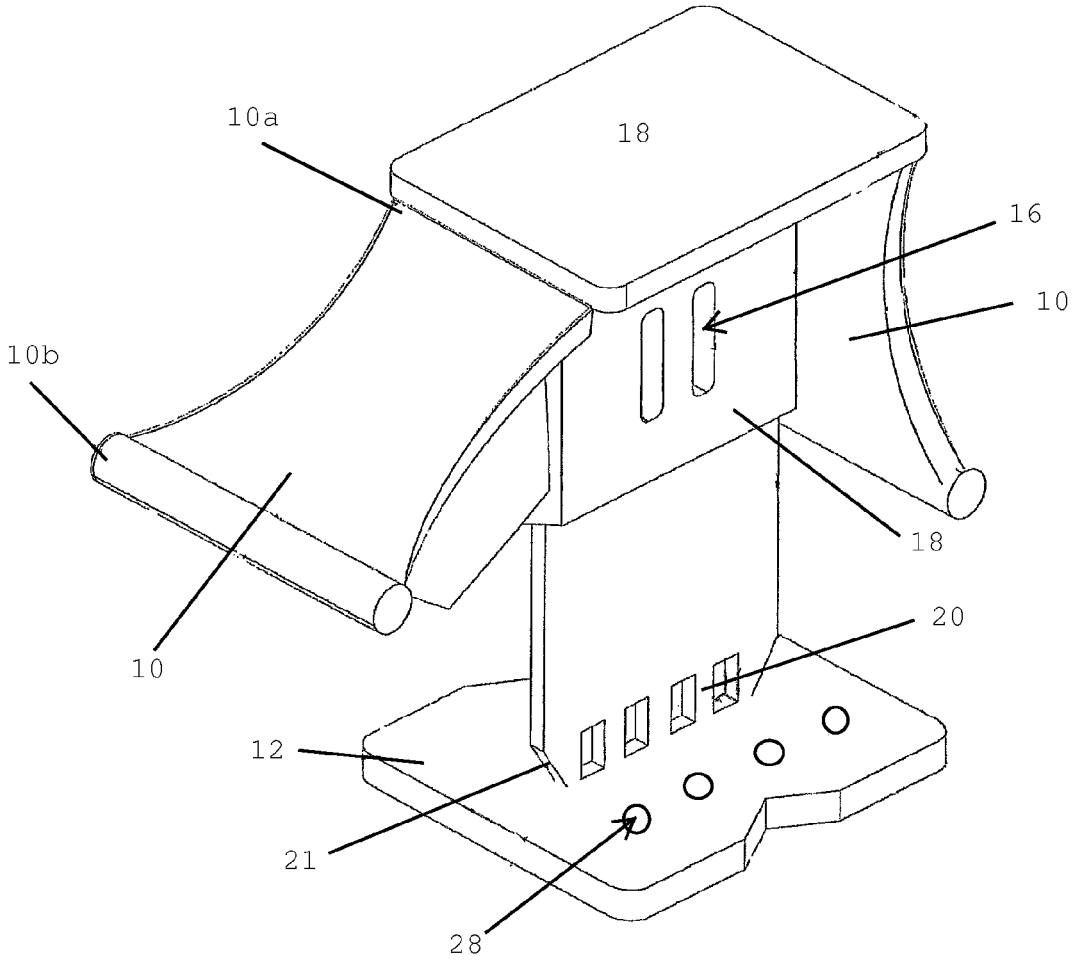
FIG. 4 is a perspective view of an embodiment of the invention.

The invention comprises a tile alignment and leveling device. The device can be used to align and level tiles that are being secured to any suitable substrate, including floors, walls, and countertops. The device includes at least one flexible member 10 and a bottom plate 12. In the embodiment shown in FIGS. 1-13, the flexible members 10 and bottom plate 12 are combined by an intermediate member 18 which spaces the flexible members 10 and bottom plate 12 at a predetermined vertical distance. The flexible members 10 have a first end 10*a*, a second end 10*b*, and a securing mechanism. The first end 10*a* is pivotally combined with the intermediate member 18 thereby allowing the flexible members 10 to pivot between a first position wherein the flexible members 10 are unsecured and allowed to pivot freely and a second position wherein the flexible members 10 are locked in their downward/engaged position.

The securing mechanism is used to secure the flexible members 10 in their second position. In the embodiments shown in FIGS. 1-6, the securing mechanism is a protruding fastening member 14 received by an opening 16. In the embodiments shown in FIGS. 1-6, the protruding fastening member 14 is combined with the flexible member 10 and the opening 16 is in the intermediate member 18. It should be noted, however, that the location of the securing mechanism components can be reversed. Any suitable securing mechanism may be used, including snaps, buttons, VELCRO, and quick set adhesives.

Figure 5:
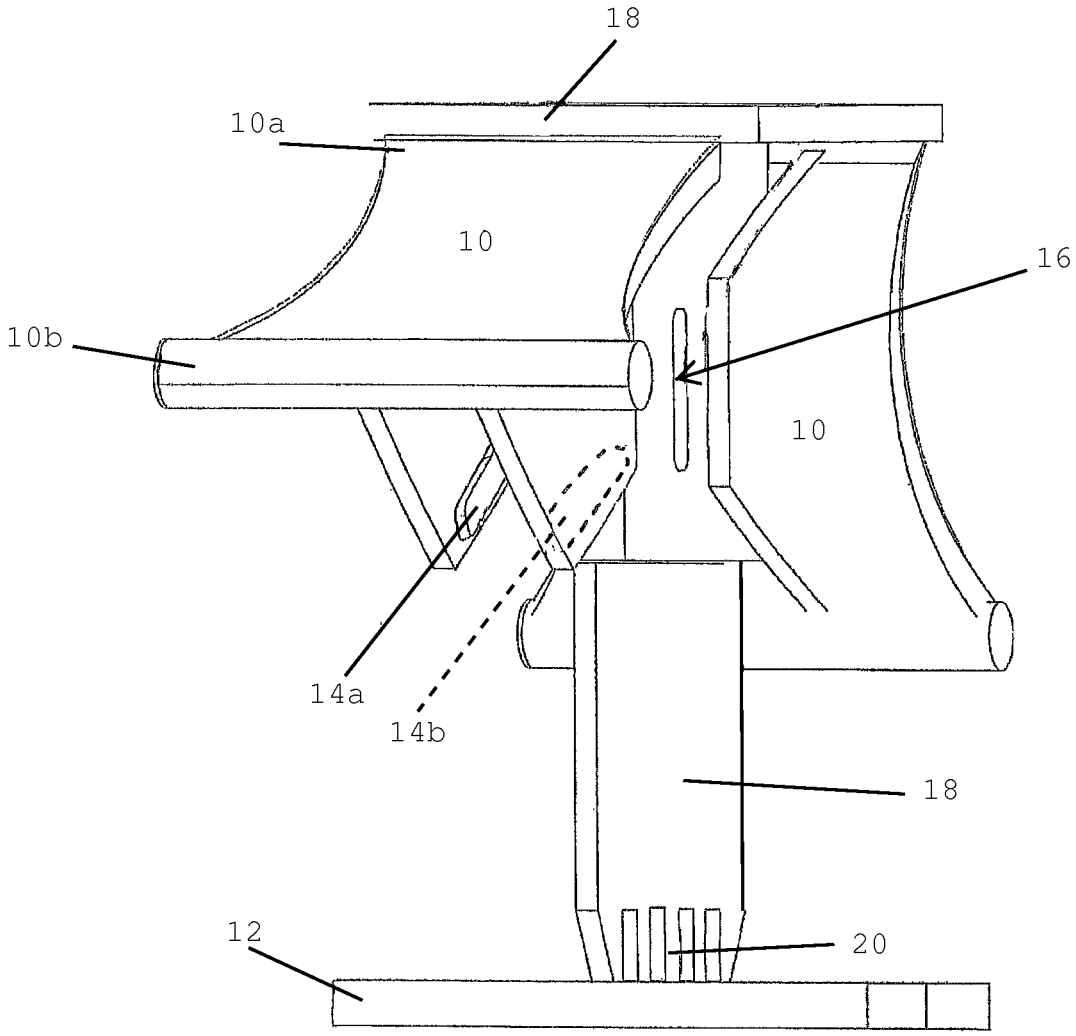
FIG. 5 is a perspective view of an alternate embodiment of the invention having an additional securing mechanism.

FIGS. 1-4 show an embodiment wherein each flexible member 10 has a single securing mechanism. FIG. 5 shows an alternate embodiment wherein each flexible member 10 has more than one securing mechanism. FIG. 5 shows a flexible member 10 having two fastening members 14. A first fastening member 14*a* is positioned on one side of the intermediate member 18 and a second fastening member 14*b* is positioned on a second side of the intermediate member 18. The fastening members 14*a*, 14*b* are received by one or more openings 16 in the intermediate member 18.

Figure 8:
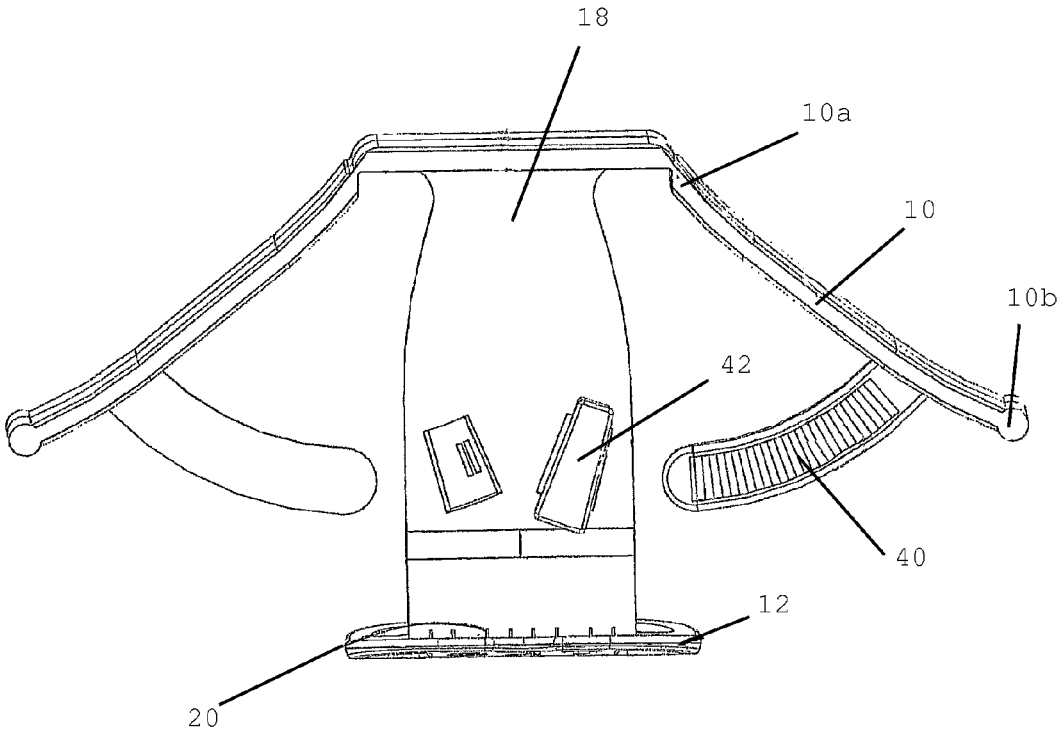
FIG. 8 is a front view of an alternate embodiment wherein the securing mechanism is a locking pawl system.
Figure 9:
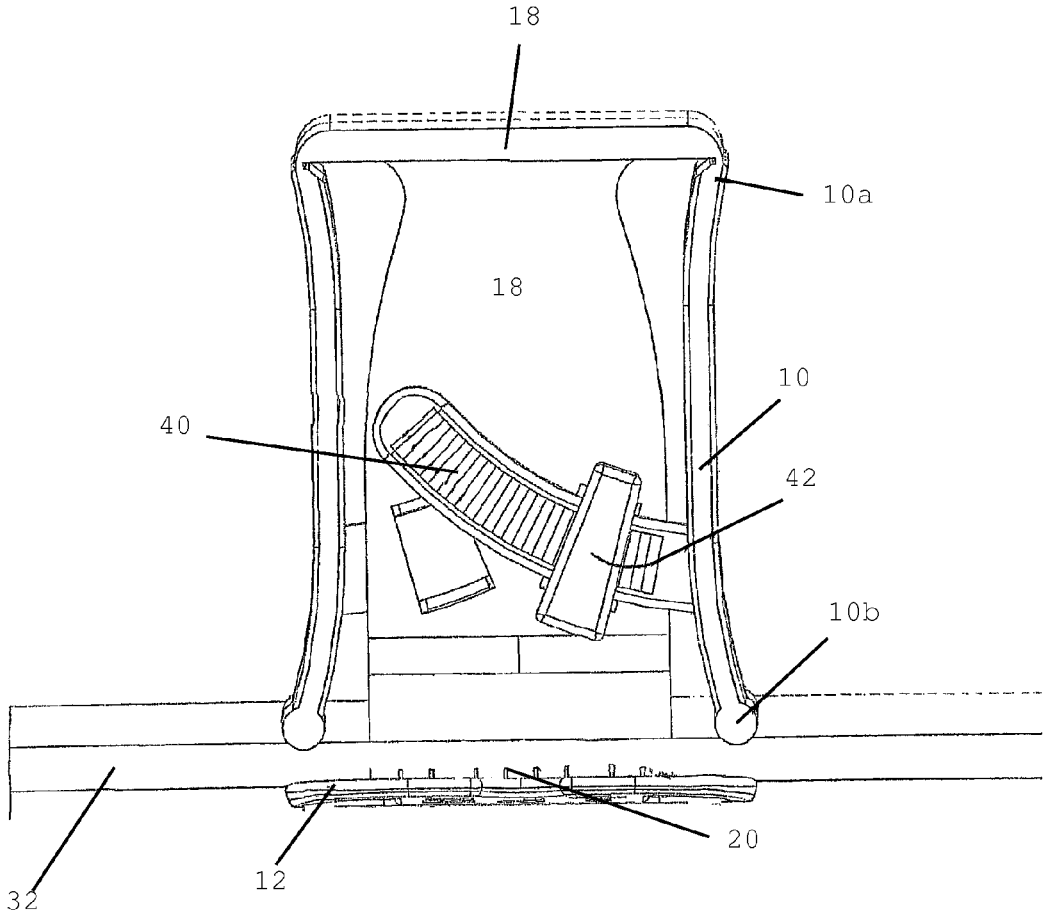
FIG. 9 is a front view of the embodiment of FIG. 8 showing the flexible members in their locked position.

FIGS. 8 and 9 show an alternate embodiment wherein the securing mechanism comprises a ratchet or locking pawl system. This system is similar to a cable tie wherein a protruding locking tongue allows movement of the flexible member 10 in one direction but not in the opposite direction. As shown, the locking pawl system has a shaft 40 with a plurality of teeth combined with the flexible members 10 and a locking pawl 42 is combined with the intermediate member 18. It should be noted, however, that the location of the securing mechanism components can be reversed. The locking pawl 42 interferes with the teeth to allow the flexible members 10 to move in a first direction (downward) but prevent the flexible members 10 from moving in the second (opposite) direction. In some embodiments the locking pawl 42 comprises a release mechanism that may be manually activated by the user to release the interference between the pawl 42 and the teeth thereby allowing movement of the flexible members 10 in the second (upward) direction. The teeth engage the locking pawl 42 so that it allows the flexible member 10 to be secured at multiple locking positions to accommodate a variety of thicknesses of tile 32.

Figure 11:
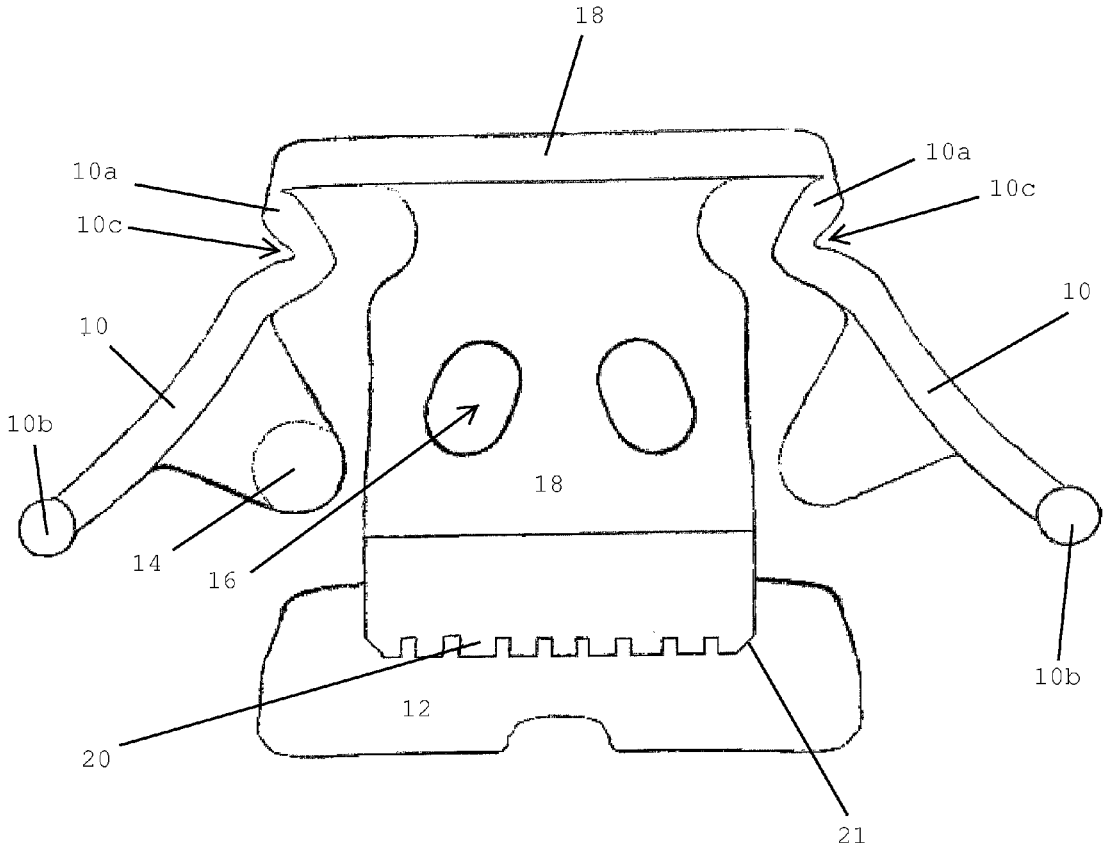
FIG. 11 is a front view of an embodiment wherein the flexible members have a bend which allows for greater flexibility to accept different thickness of tile.

FIG. 11 shows an embodiment wherein the openings 16 in the intermediate member 18 are larger than the fastening members 14. In the embodiment shown, the openings 16 are oval, however, they can be other suitable shapes includes slots, or circles. The larger openings 16 allow the fastening members 14 to be secured in a number of different positions depending on the thickness of the tile 32. In other words, for thicker tile 32 the fastening members 14 may rest farther to the top of the openings 16 and for thinner tile 32 the fastening members 14 may rest farther to the bottom of the openings 16. This feature allows the device to be used with tile 32 having different thicknesses.

Figure 6:
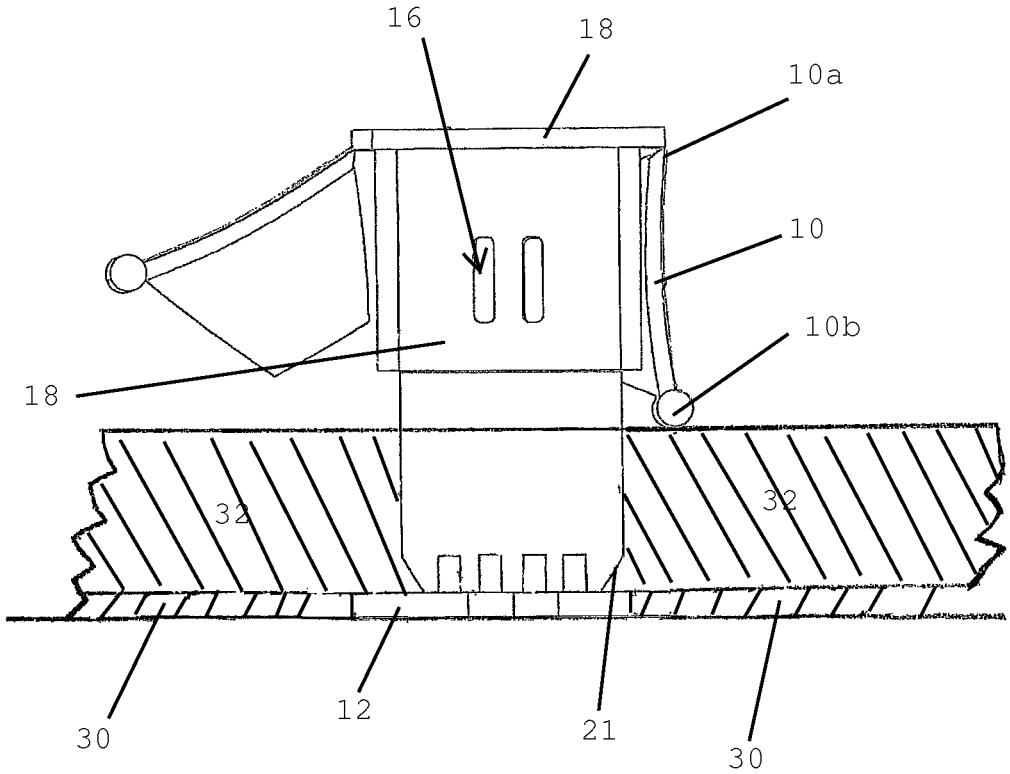
FIG. 6 is a front view of the device being used with a tile.
Figure 7:
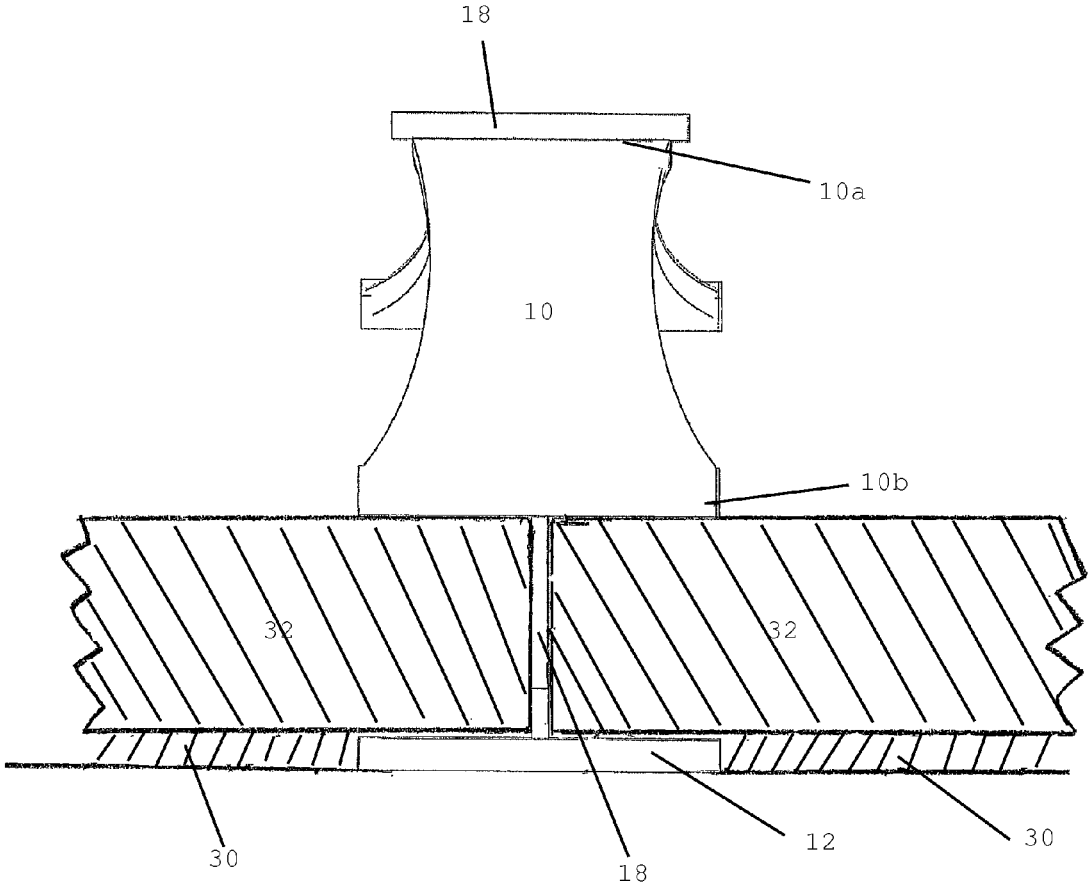
FIG. 7 is a side view of the device being used with two tiles.

FIGS. 6 and 7 show the device being used with tile 32. A typical first step in laying tile 32 is the application of a setting bed 30, such as a cement or mortar compound, to the substrate surface. Thereafter, the tiles 32 can be placed in the setting bed 30. During these steps the bottom plate 12 is positioned in the setting bed 30 beneath the tiles 32 so that the intermediate member 18 extends upward between adjacent tiles. The bottom plate 12 is preferably positioned so that it is in contact with more than one tile 32. The flexible members 10 are in their first position as the tiles 32 are placed on the bottom plate 12. Thereafter, the flexible members 10 are moved to their second position and secured by the securing mechanism. In the second position the flexible members' second end 10*b* presses against the top of the tiles 32 causing the top of the tiles 32 to be sandwiched between the flexible member second end 10*b* and the bottom plate 12. The pressure between these two components aligns the edges of the tiles 32 in the same plane with minimal or no lippage. In the embodiment shown in FIGS. 2 and 6, the flexible members' second end 10*b* is rounded. This rounded shape helps to reduce resistance between the flexible member second end 10*b* and the tile 32 as the flexible members' second end 10*b* passes over the top of the tile 32 while being moved to their second position. Any rounded shape including oval, cylinder, and semi-circle would also work to minimize resistance.

Figure 13:
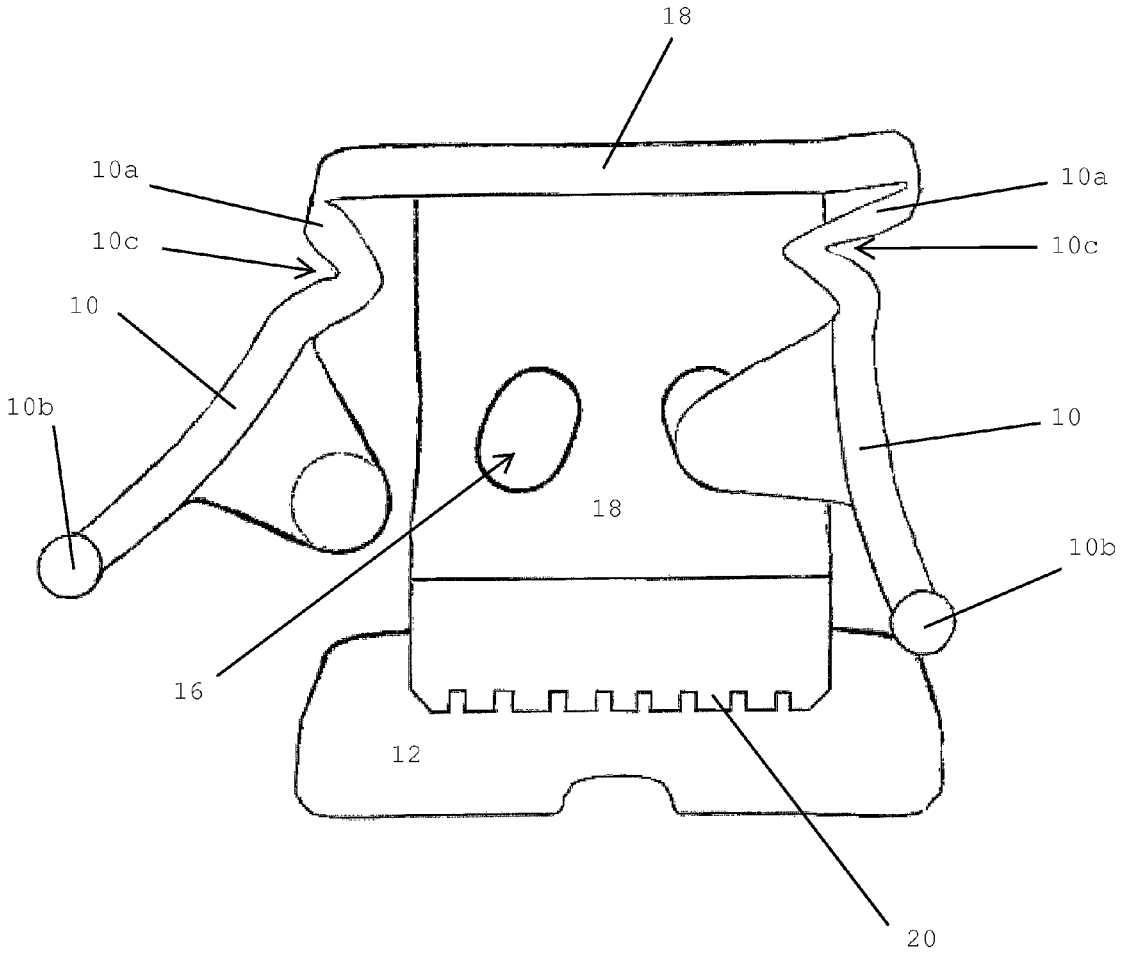
FIG. 13 is a front view of the embodiment of FIG. 11 wherein one of the flexible members is in its second position.

In some embodiments the flexible members 10 are comprised of a generally stiff material that has a slight flexible or spring-like quality, such as a plastic composite. As shown best in the embodiment of FIG. 2, a portion of the flexible members 10 is curved. The flexibility and curvature of the flexible members 10 allows the device to be used with tiles 32 of different thicknesses since the flexible members 10 can simply bend or flex for thicker tile 32 as they are moved to their second position and secured by the securing mechanism. The flexible members 10 are moved from their first position to their second position then secured in their second position. In order to function properly, the tile 32 must be thicker than the distance D (FIG. 2) between the flexible member second end 10*b* and the bottom plate 12 to allow the flexible member second end 10*b* to exert force on the tile 32 when in its second position. FIGS. 11 and 13 show an embodiment wherein the flexible members 10 comprise a bend 10*c* which helps them to flex even farther than the flexible members 10 shown in FIG. 2 to accept different thicknesses of tile. In some embodiments, portions of the intermediate portion 18 are also flexible. This can be seen in FIG. 13 wherein the horizontal portion of intermediate portion 18 flexes upward at its outer end when the flexible member 10 is in its second position.

Figure 12:
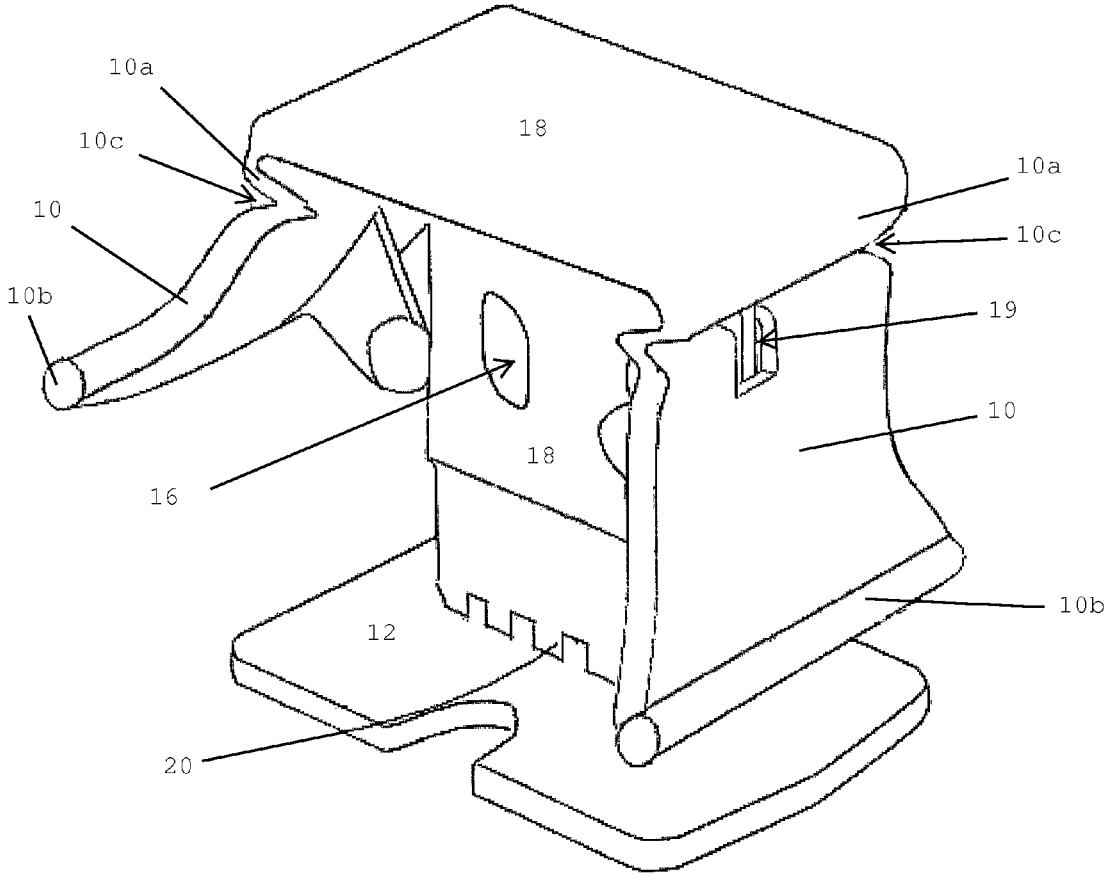
FIG. 12 is a perspective view showing an embodiment having an opening in the flexible members.

FIG. 12 shows an embodiment having an opening 19 in the flexible members 10. This opening 19 is adapted to receive a portion of the intermediate portion 18 as the flexible members 10 are moved from their first position to their second position. This helps with alignment thereby making it easier for the user to secure the securing mechanism in its proper position.

Figure 14:
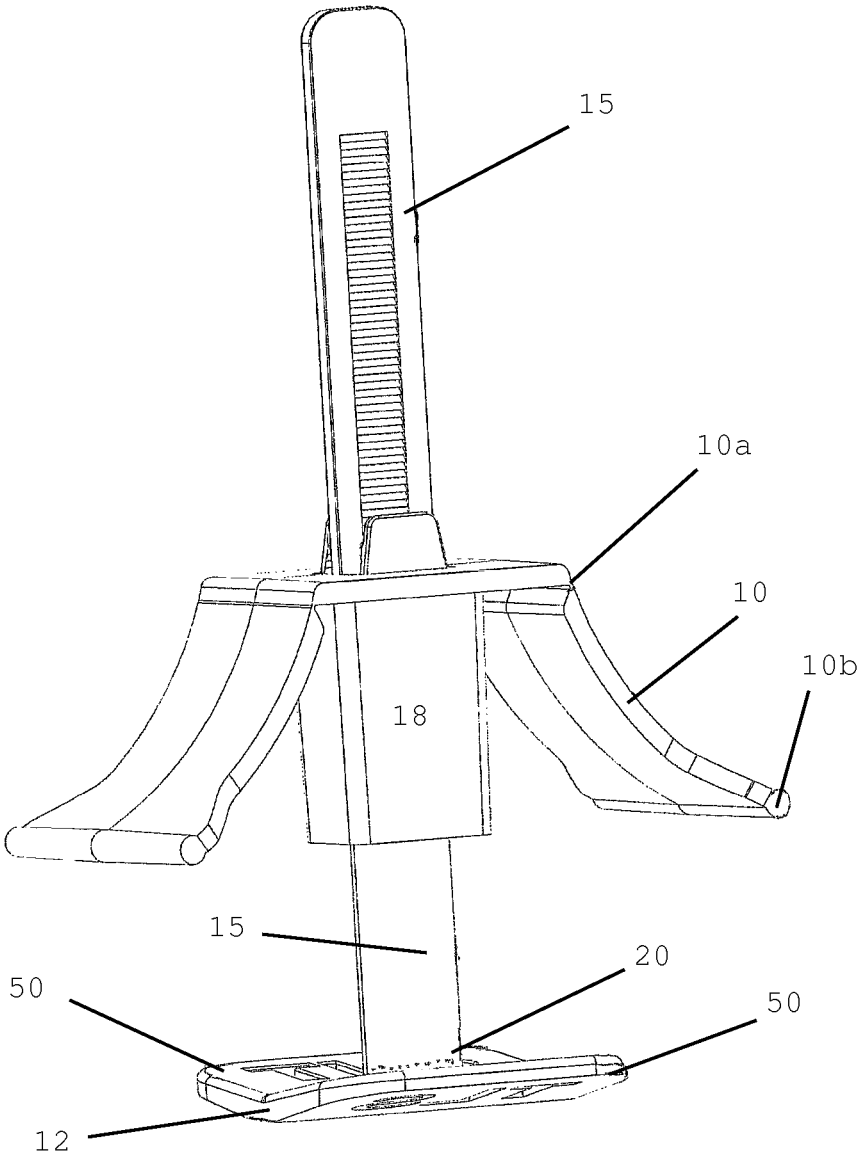
FIG. 14 is a perspective view of an embodiment wherein the intermediate member slides along a shaft.
Figure 15:
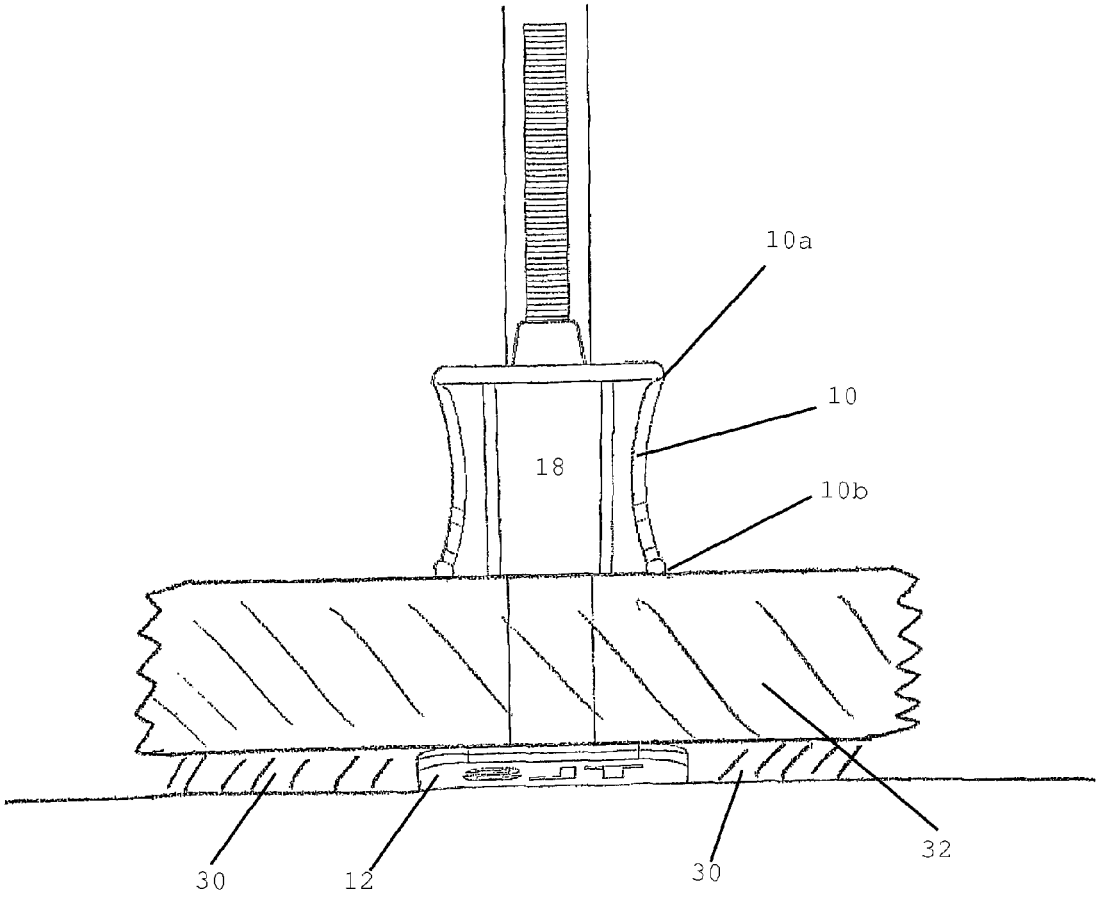
FIG. 15 is a front view of the embodiment shown in FIG. 14 wherein the device is being used with a tile.

FIGS. 14 and 15 show an alternate embodiment wherein the bottom plate 12 has a shaft 15 extending upwardly therefrom and the intermediate member 18 has an opening adapted to receive the shaft. The intermediate member 18 is prevented from moving upward along the shaft 15 by any suitable locking mechanism, including a locking pawl system (similar to the locking pawl system described above) wherein the locking mechanism allows the intermediate member 18 to move in a first direction along the shaft (toward the bottom plate 12) but prevents the intermediate member 18 from moving in a second (opposite) direction. As shown in FIG. 15, once the tiles 32 are properly positioned and the bottom plate is placed beneath the tiles 32 as described above for the previous embodiments, the intermediate member 18 is moved down the shaft 15 toward the tiles 32. The flexible members 10 are then moved from their retracted position (FIG. 14) to their compressed position (FIG. 15) where they exert force against the tiles 32. The distance between the top of the intermediate member 18 (roughly point 10*a*) and the top of the tile 32 is shorter than the length of the flexible members 10. This causes the flexible members 10 to bend as they are moved to their compressed position which in turn causes them to exert force against the tiles 32 as they try to return to their relaxed state. The flexible members 10 remain in the compressed position until a user forces the flexible members 10 back to their retracted position. The flexible members 10 remain in their compressed position without assistance from any securing mechanism since, in the compressed position, the second end 10*b* of the flexible members 10 is pushed to a position where it is below or inside of (e.g. closer to the shaft 15 than) the first end 10*a* of the flexible members 10. The flexible members 10 remain snapped or locked in their compressed position since the distance between the first end 10*a* and the second end 10*b* is longer than the distance between the first end 10*a* and the tile 32. In other words, the already compressed flexible members 10 would need to become even more compressed (bent) in order to move from their compressed position to their retracted position. This causes the flexible members 10 to become locked or snapped in their compressed position without assistance from any securing mechanism.

It should be noted that the embodiment described in the preceding paragraph and shown in FIGS. 14 and 15 wherein the intermediate member 18 slides along a shaft 15 may use securing mechanisms (as described for other embodiments) to secure the flexible members 10 in their downward position instead of the locking engagement means described in the previous paragraph. Similarly, embodiments shown and described herein wherein the intermediate member 18 combines directly with the bottom plate 12 (with no shaft 15) which use securing mechanisms to retain the flexible members 10 in their downward position may instead use the locking engagement means described in the previous paragraph.

As seen best in FIG. 1, the bottom plate 12 preferably comprises one or more openings 28. The openings 28 allow the setting bed material to seep through the bottom plate 12. This seepage allows the setting bed material 30 to bond with the portion of the tile 32 directly above the bottom plate 12, which otherwise may not contact much of the setting bed material 30. Further, the seepage helps to ensure that the tiles 32 remain level as forces are applied to the plate 12, setting bed material 30, and/or tiles 32 during leveling and setting. If the setting bed material 30 was not allowed to seep through the bottom plate 12, the setting bed material 30 could raise the bottom plate 12 as it dried which would consequently affect the level of the tiles 32.

After the setting bed dries and the tiles 32 are secured to the substrate, the user removes the portion of the device that is visible above the laid tiles 32, i.e. the intermediate member 18, the flexible members 10, and the shaft 15 (in some embodiments). In the embodiment shown in FIGS. 1-13, the intermediate member 18 comprises a separation point 20 near the connection of the intermediate member 18 and the bottom plate 12. In the embodiment shown in FIGS. 14 and 15, the separate point 20 is on the shaft 15 near its connection with the bottom plate 12. The separation point 20 is structurally weaker than the remainder of the intermediate member 18 (or shaft 15) so that the user can apply force to the portion of the intermediate member 18 (or shaft 15) that extends above the tiles 18 to cause the intermediate member 18 (or shaft 15) to break at its separation point 20. In some embodiments, the separation point 20 comprises a single opening which allows the separation point 20 to be structurally weaker and separate when the proper force is applied by the user. In the embodiment shown in FIGS. 1 and 11, the separation point 20 comprises a plurality of micro holes or perforations which allow the separation point 20 to be structurally weaker and separate when the proper force is applied by the user. In the embodiment shown in FIGS. 1 and 2, the separation point 20 includes an angled outer portion 21 wherein the intermediate member 18 tapers inward at each side. This angled outer portion 21 makes it easier for the user to separate the intermediate portion 18 from the bottom plate 12. In one embodiment, the curing process of the setting bed pulls moisture out of the intermediate member 18 (or shaft 15) making it more brittle. This makes it easier for the user to break at the separation point 20. Once separated at the separation point 20, the bottom plate 12 remains below the tiles 32 and is therefore not reusable. The intermediate member 18 (or shaft 15) is preferably made of a semi-rigid nylon which allows it to be more easily broken at its separation point 20.

Figure 10:
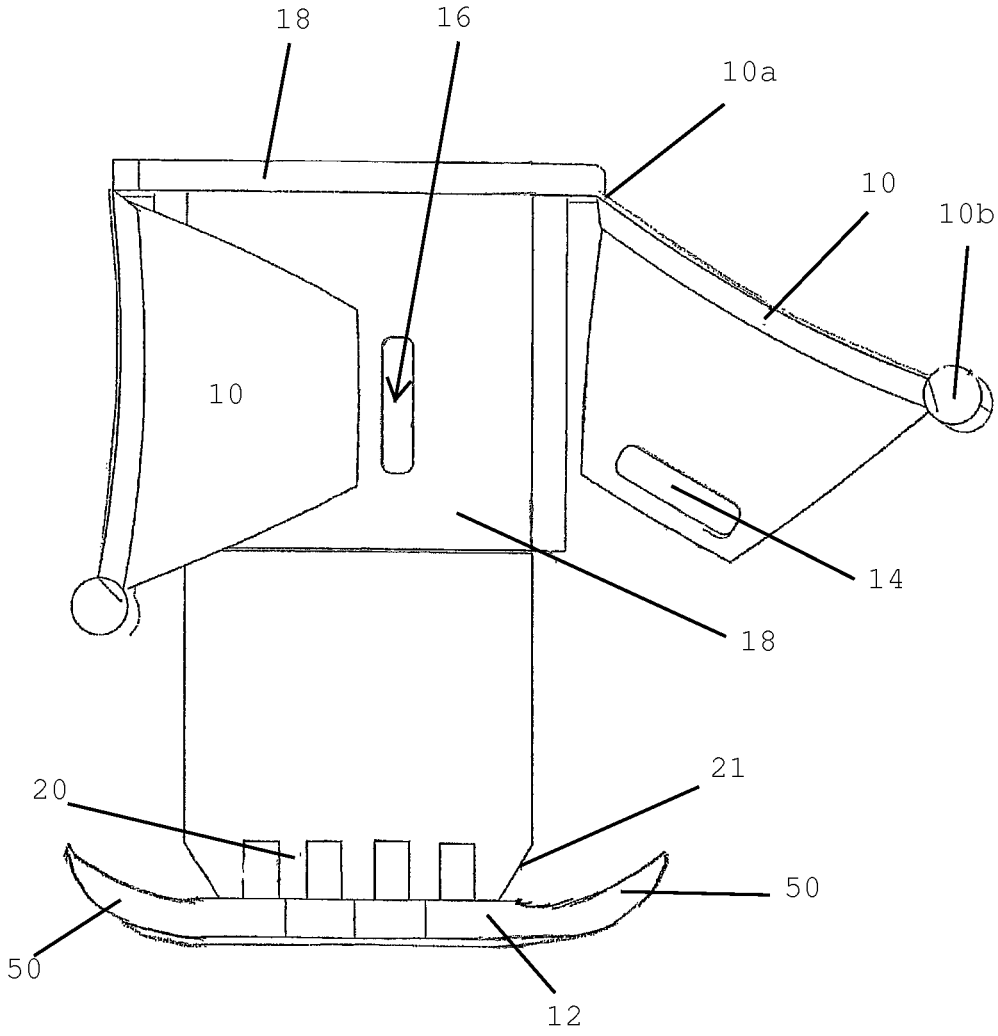
FIG. 10 is a front view of an embodiment wherein the bottom plate has flexible members.

FIGS. 10 and 14 shows an embodiment wherein at least a portion of the bottom plate 12 is comprised of a material that has a flexible or spring-like quality similar to the types of materials that may be used for the flexible members 10. The flexible portion 50 of the bottom plate 12 is movable between a compressed position and a retracted position. The flexible portion 50 of the bottom plate 12 is biased in its retracted position wherein the flexible portion 50 extends upward. Weight from the tiles 32 or force applied from above causes the flexible portion 50 to move to its compressed position. In its compressed position, the flexible portion 50 exerts upward force on the tiles 32 as it tries to return to its retracted position. In some embodiments, the bottom plate 12 comprises two flexible portions 50 to allow the device to be used at the intersection of two tiles 32 and in other embodiments the bottom plate 12 comprises four flexible portions 50 to allow the device to be used at the intersection of four tiles 32. In the embodiment shown in FIGS. 10 and 14 each flexible portion 50 begins near the center of the bottom plate 12 and extends upward and outward therefrom. In other embodiments the flexible portion 50 begins near the outer ends of the bottom plate 12 and extends upward and inward. As shown in FIG. 10, the flexible portion 50 of the bottom plate 12 may be tapered so that it is thinner at its outer end to allow the device to be easily inserted under tiles 32.

In using the embodiment shown in FIGS. 10 and 14, after the flexible member 10 is secured in place, the flexible members 10 exert downward force against the top of the tiles 32 while the flexible portion 50 of the bottom plate 12 exerts upward force against the bottom of the tiles 32. The opposing forces work to help ensure the tiles 32 are firmly held between the flexible member 10 and bottom plate 12 to help ensure an even surface.

The embodiment shown in FIGS. 10 and 14 is also useful in situations where adjacent tiles 32 have different thicknesses. The flexible portion 50 of the bottom plate 12 can be compressed under the weight of the thicker (heavier) tile 32, while the flexible or spring-like quality of the bottom plate 12 can remain in its retracted position under the thinner (lighter) tile 32 thereby holding the two adjacent tiles 32 at the same elevation. In this manner, the tile alignment and leveling device is self-adjusting after it has been placed under the tiles 32.

Most existing tile leveling systems require tools, some of which are very expensive. One feature of this device is that absolutely no tools are necessary since the flexible members 10 can be made to exert force against the tiles 32 with only the user's hands. Not needing tools for the installation makes this device more affordable for the DIY market.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A device for laying and leveling tiles, said device comprising:

a bottom plate having a top side and a bottom side;

a flexible member having a first end and a second end;

an intermediate member connecting the bottom plate to the flexible member;

wherein the flexible member first end is pivotally combined with the intermediate member thereby allowing the flexible member to pivot between a first position and a second position; and a securing mechanism for securing the flexible member in its second position;

wherein the flexible member second end is closer to the bottom plate in the second position and farther from the bottom plate in the first position.

2. The device of claim 1 wherein the securing mechanism is a fastening member adapted to be received by an opening.

3. The device of claim 2 wherein the fastening member is combined with the flexible member and the opening is in the intermediate member.

4. The device of claim 2 wherein the opening is larger than the fastening member to allow the device to be used with tiles of different thicknesses.

5. The device of claim 1 wherein more than one securing mechanism is combined with the flexible member.

6. The device of claim 1 wherein the intermediate member further comprises a separation point that is structurally weaker than the remainder of the intermediate member to allow the intermediate member to be separated from the bottom plate.

7. The device of claim 1 wherein the flexible member can be secured in different positions to accommodate tiles having different thicknesses.

8. The device of claim 1 wherein the bottom plate comprises at least one opening to allow seepage of setting bed material.

9. The device of claim 1 wherein the bottom plate further comprises a flexible portion that extends upwardly above the top surface of the bottom plate and is movable between a compressed position and a retracted position, said flexible portion being biased in its retracted position.

10. A device for laying and leveling tiles, said device comprising:

a bottom plate having a top side and a bottom side;

a flexible member having a first end and a second end;

an intermediate member connecting the bottom plate to the flexible member;

wherein the flexible member first end is pivotally combined with the intermediate member thereby allowing the flexible member to pivot between a first position and a second position; and a securing mechanism for securing the flexible member in its second position;

wherein the securing mechanism is a locking pawl assembly.

11. A device for laying and leveling tiles, said device comprising:

a bottom plate having a top side and a bottom side;

a flexible member having a first end and a second end;

an intermediate member connecting the bottom to the flexible member;

wherein the flexible member first end is pivotally combined with the intermediate member thereby allowing the flexible member to pivot between a first position and a second position; and a securing mechanism for securing the flexible member in its second position;

wherein the flexible member second end is rounded to reduce friction with the tile as the flexible member is being moved to its second position.

12. A device for laying and leveling tiles, said device comprising:

a bottom plate having a top surface;

a shaft combined with and extending upwardly from the top surface of the bottom plate;

an intermediate member having an opening adapted to receive the shaft;

a flexible member combined with the intermediate member, said flexible member having a first end and a second end;

wherein the flexible member first end is pivotally combined with the intermediate member thereby allowing the flexible member to pivot between a first position wherein it is farther from the bottom plate and a second position wherein it is closer to the bottom plate;

wherein the flexible member is adapted to be lockingly engaged with the tile when in its second position; and a locking mechanism operatively connecting the intermediate member and the shaft, said locking mechanism allowing the intermediate member to move in a first direction along the shaft but not in a second direction along the shaft.

13. The device of claim 12 wherein the shaft further comprises a separation point that is structurally weaker than the remainder of the shaft to allow the shaft to be separated from the bottom plate.

14. The device of claim 12 wherein the bottom plate comprises at least one opening to allow seepage of setting bed material.

15. The device of claim 12 wherein the bottom plate further comprises a flexible portion that extends upwardly above the top surface of the bottom plate and is movable between a compressed position and a retracted position, said flexible portion being biased in its retracted position.

16. A device for laying and leveling tiles, said device comprising:

a bottom plate having a top surface;

a shaft combined with and extending upwardly from the top surface of the bottom plate;

an intermediate member having an opening adapted to receive the shaft;

a flexible member combined with the intermediate member, said flexible member having a first end and a second end;

wherein the flexible member first end is pivotally combined with the intermediate member thereby allowing the flexible member to pivot between a first position wherein it is farther from the bottom plate and a second position wherein it is closer to the bottom plate;

a securing mechanism for securing the flexible member in its second position; and a locking mechanism operationally connecting the intermediate member and the shaft, said locking mechanism allowing the intermediate member to move in a first direction along the shaft but not in a second direction along the shaft.

17. The device of claim 16 wherein the shaft further comprises a separation point that is structurally weaker than the remainder of the shaft to allow the shaft to be separated from the bottom plate.

18. The device of claim 16 wherein the securing mechanism is a fastening member adapted to be received by an opening.

19. The device of claim 16 wherein the securing mechanism is a locking pawl assembly.

20. The device of claim 16 wherein the bottom plate comprises at least one opening to allow seepage of setting bed material.

21. The device of claim 16 wherein the bottom plate further comprises a flexible portion that extends upwardly above the top surface of the bottom plate and is movable between a compressed position and a retracted position, said flexible portion being biased in its retracted position.

* * * * *